US006891457B2

(12) United States Patent
Sako

(10) Patent No.: US 6,891,457 B2
(45) Date of Patent: May 10, 2005

(54) POWER TOOLS

(75) Inventor: Masahiko Sako, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/772,061

(22) Filed: Feb. 4, 2004

(65) Prior Publication Data

US 2004/0155743 A1 Aug. 12, 2004

(30) Foreign Application Priority Data

Feb. 5, 2003 (JP) ..... 2003-028829

(51) Int. Cl.[7] ..... H01F 7/08
(52) U.S. Cl. ..... 335/253; 335/239; 335/254
(58) Field of Search ..... 335/239, 241, 335/253–255; 361/194; 173/112, 117

(56) References Cited

U.S. PATENT DOCUMENTS 1,604,220 A 10/1926 Davis
6,262,648 B1 * 7/2001 Lammers ..... 335/229
6,687,110 B2 * 2/2004 Murray ..... 361/131
2002/0079111 A1 6/2002 Camp

FOREIGN PATENT DOCUMENTS

EP 0 183981 1/1990 ..... B25C/1/06
JP 61-136777 6/1986 ..... B25C/1/06

* cited by examiner

*Primary Examiner*—Ramon M. Barrera
(74) *Attorney, Agent, or Firm*—Orrick Herrington & Sutcliffe, LLP

(57) ABSTRACT

Power tool (10) may include solenoid coil (1) that functions as a drive source for plunger (5). Battery (3) may be connected with solenoid coil (1), battery (3) supplying a current to solenoid coil (1). Solenoid coil (1) may store magnetic energy while current from battery (3) flows through solenoid coil (1). The magnetic energy stored in solenoid coil (1) may be transformed into kinetic energy of plunger (5), whereby plunger (5) being moved from a first position to a second position. The magnetic energy stored in solenoid coil (1) is determined by the current flowing through solenoid coil (1) and has no relationship with the voltage of battery (3). Consequently, sufficient power can be conveyed to plunger (5) even if the voltage of battery (3) is low.

22 Claims, 6 Drawing Sheets

FIG. 5
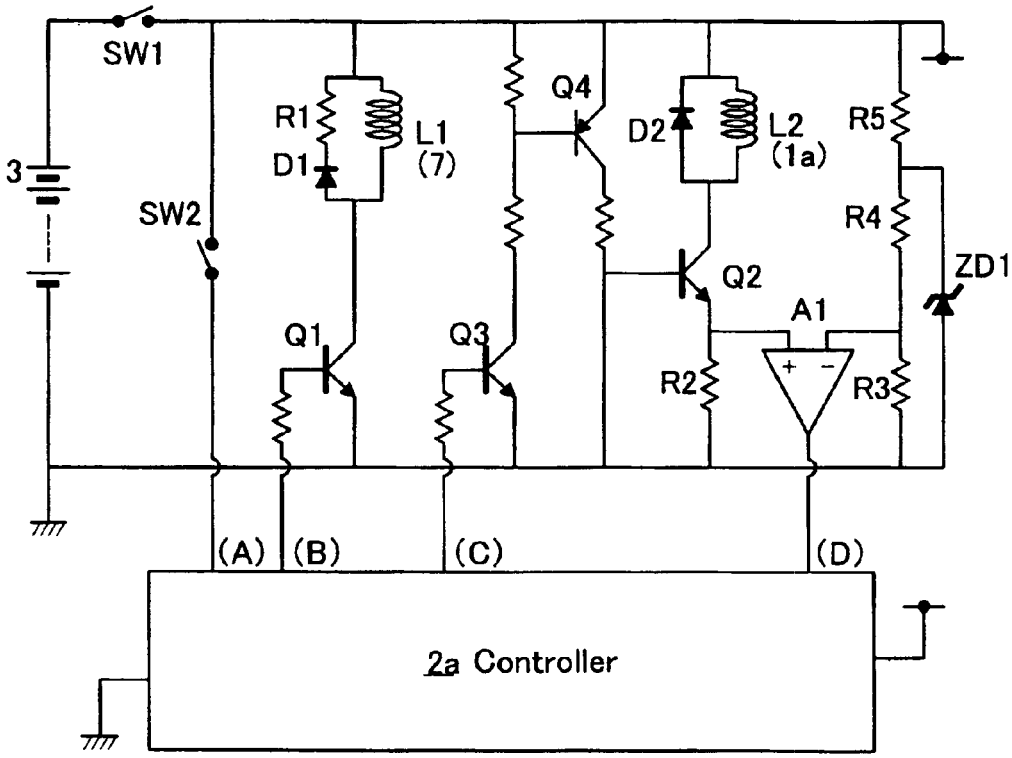
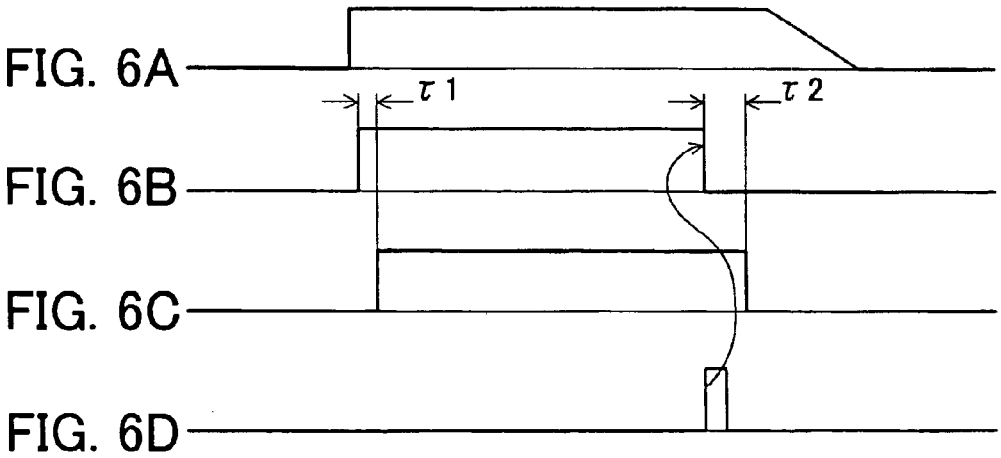

POWER TOOLS

CROSS REFERENCE

This application claims priority to Japanese patent application number 2003-28829, filed Feb. 5, 2003, the contents of which are hereby incorporated by reference as if fully set forth herein.

BACKGROUND OF THE INVENTION

1. Field of the Invention

The present invention relates to power tools, more particularly, relates to power tools, such as staplers, nailers, and tackers, having a solenoid coil that attracts a driver (e.g., plunger).

2. Description of the Related Art

Japanese Laid-open Patent Publication No. JP61-23387 describes a power tool having a driver that is attracted by a solenoid coil in order to strike nails or staples. In this known power tool, in order to accelerate the driver, a large quantity of energy must be supplied from the solenoid coil to the driver. Thus, as shown in FIG. 9, the solenoid coil is connected with a battery via a DC-DC converter and a capacitor. The DC-DC converter boosts the battery voltage, whereby a large quantity of electrical energy is stored in the capacitor. As a result, sufficient power can be supplied to the driver. However, the use of the DC-DC converter causes not only an increase in cost but also an increase in weight and size.

SUMMARY OF THE INVENTION

It is, accordingly, one object of the present teachings to provide improved power tools that, without using a DC-DC converter, is capable of drawing sufficient power from a solenoid coil.

In one aspect of the present teachings, a power tool may include a solenoid coil that functions as a drive source for driving a movable member (e.g., plunger). A power source (e.g., external power source, rechargeable battery) may be connected with the solenoid coil, the power source supplying a current to the solenoid coil. The solenoid coil may store magnetic energy while current from the power source flows through the solenoid coil. The magnetic energy stored in the solenoid coil is determined by the current flowing through the solenoid coil and has no relationship with the voltage of the power source. Consequently, a large quantity of magnetic energy can be stored in the solenoid coil even if the voltage of the power source is low. The magnetic energy stored in the solenoid coil can be transformed into kinetic energy of the movable member, this allowing a large degree of acceleration to be conveyed to the movable member. For example, the movable member may be attracted by the electromagnetic energy stored in the solenoid coil, and move from a first position to a second position. When the movable member reaches the second position, the movable member may strike against a nail or staple. By this means, the nail or staple can be driven into the work. Since the movable member is moved by means of the magnetic energy stored in the solenoid coil, sufficient power can be conveyed to the movable member even if the voltage of the power source is low.

In one embodiment of the present teachings, the power tool may include a switch that turns on and off a current from the power source to the solenoid coil. The current flows from the power source to the coil while the switch is on, and the current from the power source to the coil is halted when the switch is turned off. Further, the power tool may include a retaining means for retaining the movable member in the first position. A variety of mechanisms can be adopted as the retaining means. For example, retaining means may comprise an excitatory coil and a core. When the movable member is disposed in the first position and the current flows through the excitatory coil, the magnetic flux that is formed thereby forms through a magnetic circuit that passes through the core and the movable member, thereby strongly retaining the movable member to the core.

Preferably, the power tool may include a control device (e.g., processor, microprocessor or microcomputer) for controlling the switch and the retaining means. The control device may turn on the switch while the movable member is retained in the first position by the retaining means. By this means, the current begins to flow through the solenoid coil. Over time, the current flowing through the solenoid coil gradually increases, this being accompanied by an increase in the magnetic energy stored in the solenoid coil. Then, the control device may turn off the retaining means to stop retaining the movable member when the current flowing through the solenoid coil reaches a predetermined value. Consequently, when sufficient magnetic energy has been stored in the solenoid coil, the movable member is released from its restrained state and, attracted by the magnetic energy of the solenoid coil, the movable member moves to the second position from the first position.

These aspects and features may be utilized singularly or, in combination, in order to make improved power tool. In addition, other objects, features and advantages of the present teachings will be readily understood after reading the following detailed description together with the accompanying drawings and claims. Of course, the additional features and aspects disclosed herein also may be utilized singularly or, in combination with the above-described aspect and features.

BRIEF DESCRIPTION OF THE DRAWINGS

FIG. 4B is a graph showing plunger velocity on the vertical axis and time on the horizontal axis.

FIG. 4C is a graph showing plunger position on the vertical axis and time on the horizontal axis.

FIG. 5 is a schematic diagram showing a representative circuit of control circuit 2 of FIG. 1.

FIG. 6A is a diagram showing the timing of signals outputted from terminal (A) of controller 2*a* of FIG. 5.

FIG. 6B is a diagram showing the timing of signals outputted from terminal (B) of controller 2*a* of FIG. 5.

FIG. 6C is a diagram showing the timing of signals outputted from terminal (C) of controller 2*a* of FIG. 5.

FIG. 6D is a diagram showing the timing of signals outputted from terminal (D) of controller 2*a* of FIG. 5.

DETAILED DESCRIPTION OF THE INVENTION

Detailed Representative Embodiment

Figure 1:
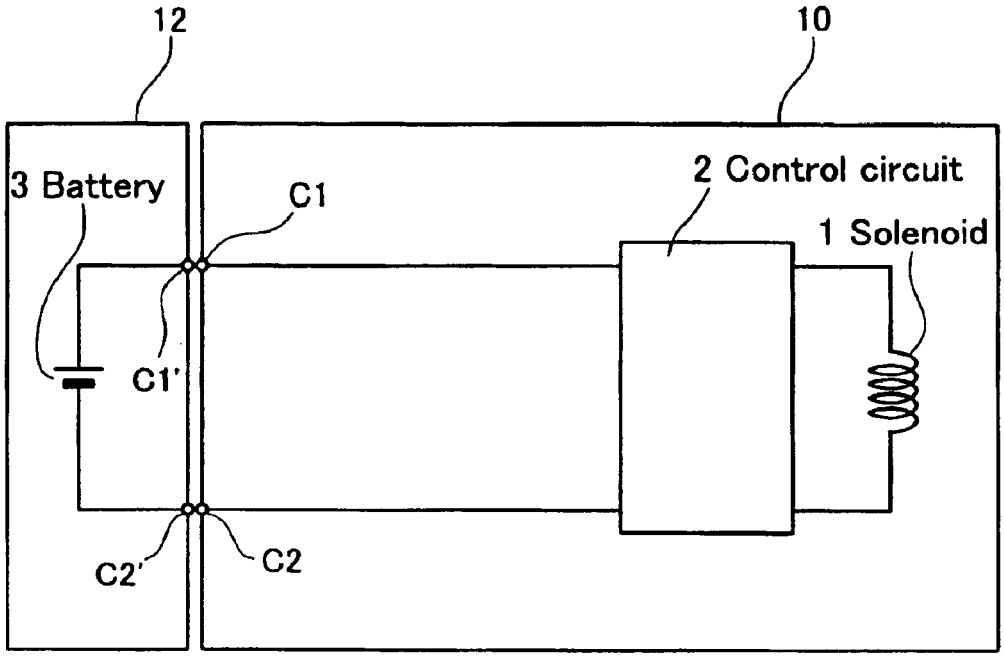
FIG. 1 is a simplified diagram showing a representative circuit of a stapler of the representative embodiment.

A stapler according to a representative embodiment of the present teachings will be explained below with reference to the drawings. FIG. 1 is a simplified diagram showing a representative circuit of the stapler. As shown in FIG. 1, when battery pack 12 is connected with stapler 10, connecting terminals C1, C2 of stapler 10 make contact with connecting terminals C1', C2' respectively of battery pack 12, and electrical contact is thereby established between stapler 10 and battery pack 12. Battery pack 12 may include battery 3, which may comprise a plurality of rechargeable battery cells (e.g., nickel metal hydride battery cells, nickel cadmium battery cells). Battery 3 is disposed within a housing of battery pack 12. Connecting terminals C1', C2' are disposed on a surface of the housing of battery pack 12.

Stapler 10 may include solenoid coil 1 and control circuit 2. Control circuit 2 can be connected with battery 3 via connecting terminals C1, C2 and C1', C2'. Control circuit 2 may be coupled to solenoid coil 1, whereby solenoid coil 1 can be connected with battery 3 via control circuit 2. Thus, battery 3 can supplies a current to solenoid coil 1. Solenoid coil 1 stores magnetic energy while current from battery 3 flows through solenoid coil 1. The electromagnetic force stored in solenoid coil 1 attracts a plunger, whereby the plunger moves in order to strike a staple. Control circuit 2 may control whether current supplied from battery 3 to solenoid coil 1 is ON or OFF, and switch the plunger between retaining state and releasing state according to a predetermined timing.

Figure 2A:
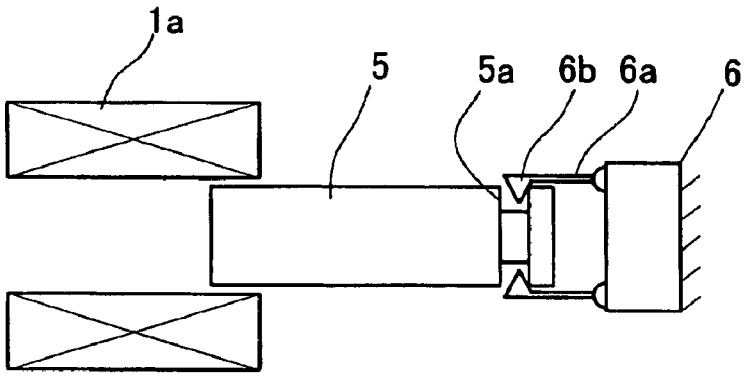
FIG. 2A shows examples of a plunger and a plunger release when the plunger release retains the plunger.
Figure 2B:
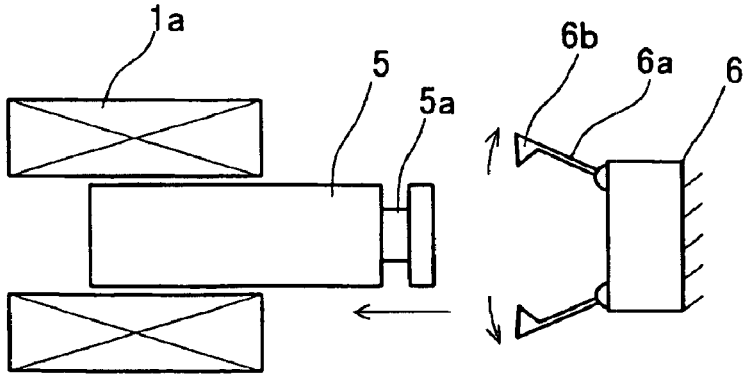
FIG. 2B shows the plunger and the plunger release of FIG. 2A after the plunger release releases the plunger.

FIG. 2 shows examples of a plunger and a retaining member (hereafter called "plunger release") that retains and releases the plunger. FIG. 2A shows plunger 5 retained in a starting position by plunger release 6, whereby plunger 5 is attracted by solenoid coil 1*a*. FIG. 2B shows a state whereby plunger 5, which have been released from plunger release 6, is being attracted to an end position by the magnetic energy of solenoid coil 1*a*. As shown in FIGS. 2A and 2B, groove 5 may be defined on an outer surface of plunger 5. Plunger release 6 may have arms 6*a* that pivot between a retaining position and releasing position. The distal end of arm 6*a* preferably has protrusion 6*b* that inwardly extends from arm 6*a*. When plunger 5 is disposed in the starting position and arms 6*a* is disposed in the retaining position, protrusions 6*b* of arms 6*a* of plunger release 6 fit with groove 5*a* of plunger 5 (see FIG. 2A). Thus, plunger 5 is securely retained by plunger release 6. When arms 6*a* of plunger release 6 pivots from the retaining position to the releasing position, plunger 5 moves from the starting position to the end position, whereby the tip of plunger 5 strikes a staple (not shown). When the electromagnetic energy of solenoid coil 1*a* dissipates, plunger 5 that has moved to the end position is moved back to the starting position by a returning means (not shown) such as a returning spring or the like. Solenoid coil 1*a* and plunger release 6 are fixed to a housing of stapler 10. The mechanical configuration of the stapler is known and thus, a detailed explanation will be omitted.

Figure 3A:
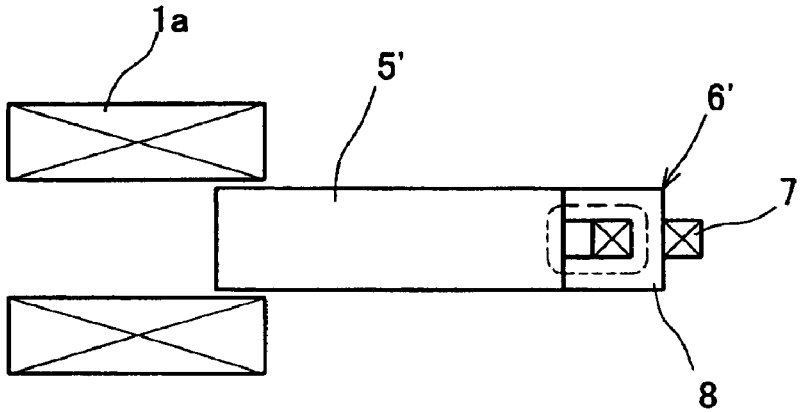
FIG. 3A shows other examples of a plunger and a plunger release when the plunger release retains the plunger.
Figure 3B:
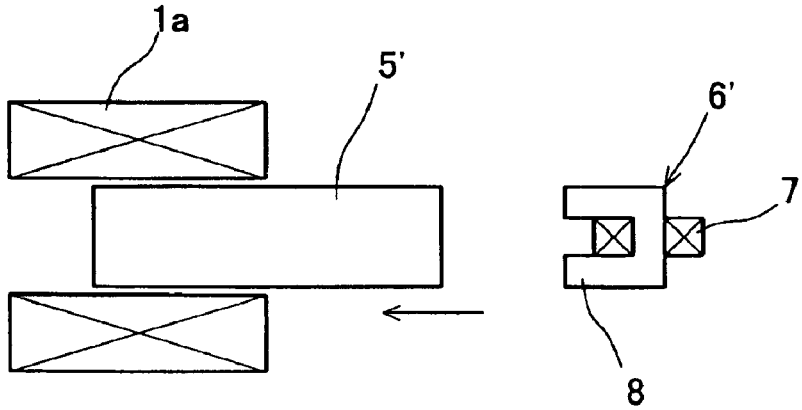
FIG. 3B shows the plunger and the plunger release of FIG. 3A after the plunger release releases the plunger.

FIGS. 3A and 3B show another example of plunger release 6' that retains and releases plunger 5'. As shown in FIGS. 3A and 3B, plunger release 6' may comprise excitatory coil 7 and approximately U-shaped core 8. When plunger 5' is disposed in a starting position and an excitatory current flows through excitatory coil 7 of plunger release 6', the magnetic flux that is formed thereby forms a magnetic circuit (a closed loop) that passes through U-shaped core 8 and one end of plunger 5', thereby strongly fixing the plunger 5' to plunger release 6' (see FIG. 3A). When plunger 5' is to be released, the current flowing through excitatory coil 7 is halted. Thus, plunger 5' is being attracted by solenoid coil 1*a* and moves toward the end position. Plunger release 6' has a simple configuration with no movable components, and as it is a structure whereby the fixing and releasing of plunger 5' is performed directly, there is no mechanical time lag and it can be expected to operate reliably.

The operational principle of stapler 10 of the representative embodiment will be explained with reference to FIG. 4. While plunger 5 is in a fixed state in the starting position, solenoid coil 1*a* is connected with battery 3 that has a voltage V. If the inductance of solenoid coil 1*a* is L, and the direct current resistance is R then, as shown in FIG. 4A, the current flowing through solenoid coil 1*a* increases over time in the manner of the curve OBH. Here, the slope of the tangent line OA is V/L. The greater the value of L, the slower the increase in the current, and over time the current (i.e., the curve OBH) asymptotes to V/R. The magnitude of energy Em stored from the inductance L created by the current i is expressed by the following formula:

$$Em=Li^2/2$$

A suitable current value is determined to be i1, and at the point B, where the current that is increasing over time reaches this value at the time t1, the connection between the solenoid coil 1*a* and the battery 3 is broken and plunger 5 is simultaneously released from its fixed state. Since solenoid coil 1*a* is provided with a flywheel circuit, plunger 5 that has been released from its fixed state is drawn to solenoid coil 1*a* with greater acceleration. At this juncture, the magnetic energy that was stored in solenoid coil 1*a* is consumed. The change in current at this juncture is shown by the curve BC in FIG. 4A. At the point C, at the time t2, plunger 5 encounters the end position of its stroke. As shown by the curve CD in FIG. 4A, after plunger 5 has encountered the end position, the current is consumed by the resistance R while the flywheel is functioning, and the current decreases. FIG. 4B and FIG. 4C schematically show changes in the speed of plunger 5 and the position of plunger 5 over time. Furthermore, the interval 0-x shown in FIG. 4C is the stroke of the plunger.

Figure 4A:
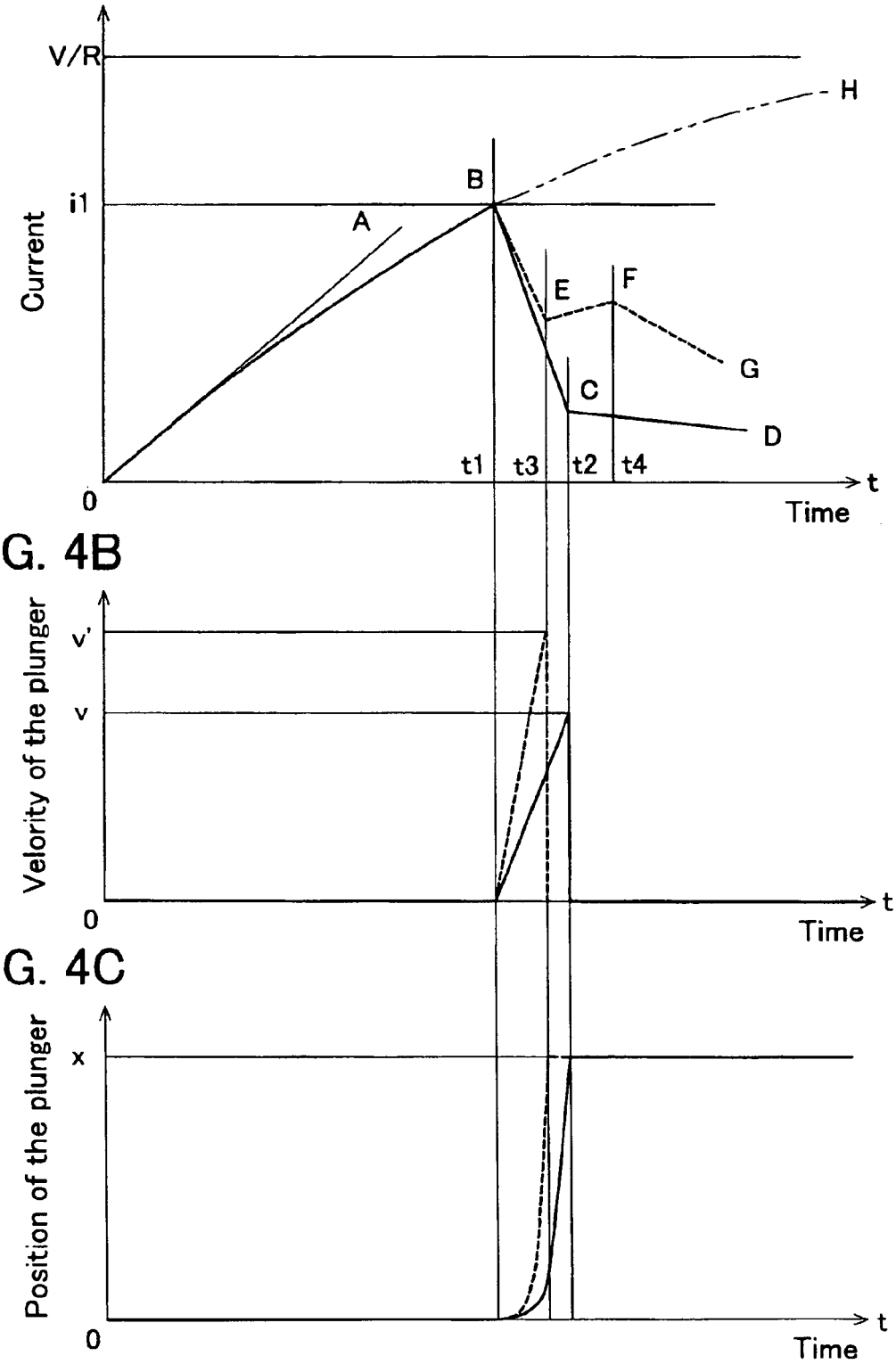
FIG. 4A is a graph showing current flow through the solenoid coil on the vertical axis and time on the horizontal axis.

If the determined value i1 is close to the value V/R in FIG. 4A (i.e., the determined value i1 is in a range where the slope of the current with respect to time is gentle), the magnetic energy stored in solenoid coil 1*a* becomes great, whereby solenoid coil 1*a* can be made small. However, since the magnetic energy is stored, and plunger 5 is accelerated, in this range where the current has a gentle slope (i.e., the resistance field), heat loss caused by the resistance R is large, and energy efficiency becomes poor. On the other hand, if the determined value i1 is made distant from the value V/R, and the range close to the tangent line OA (i.e., the inductance field) is utilized, energy efficiency can be increased. It is preferred that the determined value i1 and solenoid coil 1*a* are designed taking these points into account. For example, first the determined value i1 is set to the largest permissible current value of the battery. Then, the dimensions of solenoid coil 1*a* can be set so that the slope of the coil current due to the determined value i1 (i.e., the slope of the current in the graph of FIG. 4A) has the desired slope.

Figure 8A:
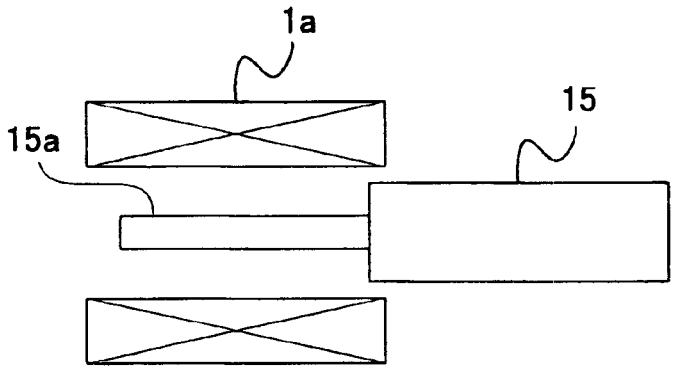
FIG. 8A shows another example of the plunger.
Figure 8B:
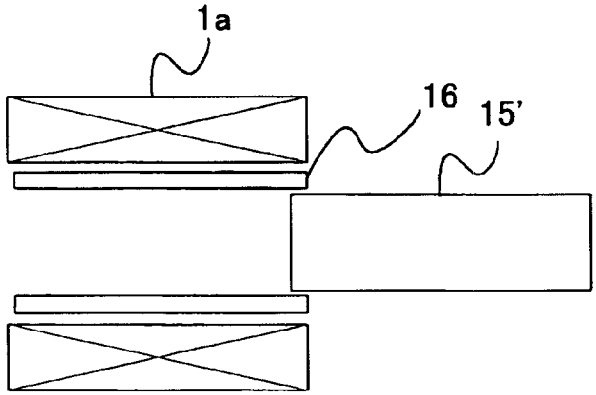
FIG. 8B shows another example of the solenoid coil.
Figure 9:
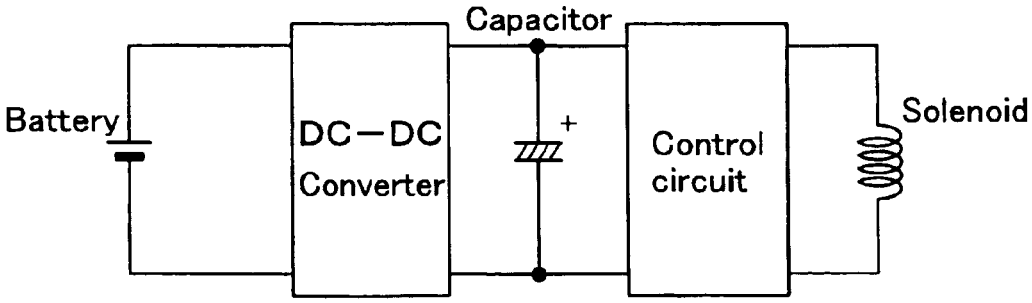
FIG. 9 PRIOR ART
FIG. 9 is a simplified diagram showing a conventional circuit of a stapler.

Further, in order to increase the magnetic energy stored in solenoid coil 1*a*, the inductance of solenoid coil 1*a* may be increased when the plunger is located in the starting position. For example, as shown in FIG. 8A, plunger 15 may have a protrusion 15*a* that forwardly extends from one end of plunger 15. When plunger 15 is in the starting position, protrusion 15*a* is inserted into solenoid coil 1*a*. This type of configuration allows the inductance of solenoid coil 1*a* to be increased. Furthermore, as shown in FIG. 8B, magnetic substances 16 (e.g., metal plate) may be disposed within solenoid coil 1*a*, whereby the inductance of solenoid coil 1*a* can be increased.

In the above description, the connection between solenoid coil 1*a* and battery 3 is broken at the same time as plunger 5 is released. However, this may be performed as a separate operation. For example, the power source voltage applied to solenoid coil 1*a* is not halted at the point B of FIG. 4A, namely time t1, and instead only plunger 5 is released from its fixed state. Then, after plunger 5 has reached the end position at time t3, the connection between battery 3 and solenoid coil 1*a* is broken at the time t4. The coil current at this juncture is the curve BEFG shown by the dotted line in FIG. 4A. As shown in FIG. 4B, the speed of plunger 5 can be greater than in the case where the power source voltage apply is halted at the time t1.

A representative circuit diagram for control circuit 2 of stapler 10 will be explained with reference to FIG. 5. In FIG. 5, L1 is a coil of plunger release 6 (e.g., excitatory coil 7 in FIG. 3A), and Q1 is a switch (e.g., transistor) of coil L1. Switch Q1 may be coupled to terminal (B) of controller 2*a*. Controller 2*a* turns on/off switch Q1 in order for plunger release 6 to retain or release plunger 5. Resistor R1 may be added into the flywheel circuit in addition to diode D1, whereby improving the response of plunger release 6. Further, L2 is solenoid coil 1*a*, Q2 is a switch thereof. Q3 and Q4 are switches for turning on/off switch Q2. Switch Q3 may be coupled to terminal (C) of controller 2*a*. Controller 2*a* turns on/off switch Q3. When switch Q3 is turned on by controller 2*a*, switch Q4 and switch Q2 are turned on.

A current flowing through switch Q2 from solenoid coil L2 may be detected as voltage formed by resistor R2. The voltage formed by resistor R2 may be input to the + terminal of comparator A1, and is compared with a reference voltage determined by resistors R3 and R4 and Zener diode ZD1 for stabilizing the voltage. Furthermore, in the case where battery 3 is discharged and the battery voltage falls below a predetermined voltage, the current does not pass through Zener diode ZD1, and the reference voltage determined by resistors R3 and R4 decreases proportionally with the battery voltage. That is, the determined current i1 in FIG. 4A decreases proportionally with the battery voltage. By this means, when the battery voltage decreases, the value V/R of FIG. 4A is prevented from approaching the determined current i1. The output terminal of comparator A1 may be coupled to terminal (D) of controller 2*a*. Thus, the output signals from comparator A1 is input to the terminal (D) of controller 2*a*. Controller 2*a* determines whether the voltage formed by resistor R2 exceeds the reference voltage. Controller 2*a* may further include terminal (A) that is coupled to battery 3 via trigger switch SW2 and power source switch SW1. Power source switch SW1 and trigger switch SW2 are operated by the user.

A representative operation of control circuit 2 will be explained with reference to a timing chart shown in FIGS. 6A–6D. FIG. 6A is a timing chart of a signal input to terminal (A) of controller 2*a*, FIG. 6B is a timing chart of a signal output from terminal (B) of controller 2*a*, FIG. 6C is a timing chart of a signal output from terminal (C) of controller 2*a*, and FIG. 6D is a timing chart of a signal input to terminal (D) of controller 2*a*. After power source switch SW1 has been turned on by the user, trigger switch SW2 is further turned on by the user (see FIG. 6A), whereby controller 2*a* turns on switch Q1 (see FIG. 6B). By this means, an excitatory current flows through the coil L1 of plunger release 6. After a time τ1 has elapsed allowing plunger release 6 to reliably fix plunger 5, controller 2*a* turns on switch Q3 (see FIG. 6C). By this means, switch Q4 is turned on, and switch Q2 is turned on. As a result, the battery voltage is applied to solenoid coil L2, and current begins to flow through solenoid coil L2. When the current value flowing through solenoid coil L2 reaches the determined value i1, comparator A1 sends an ON signal to terminal (D) of controller 2*a* (see FIG. 6D). Controller 2*a*, after receiving the ON signal from comparator A1, turns off switch Q1 and thereby cuts off the current to coil L1, and releases plunger 5 (see FIG. 6B). At this juncture, after a time τ2 has elapsed, controller 2*a* turns off switch Q3 (see FIG. 6C). By this means, switches Q4 and Q2 are turned off, and the current supply to solenoid coil L2 from battery 3 is cut off.

Figure 7:
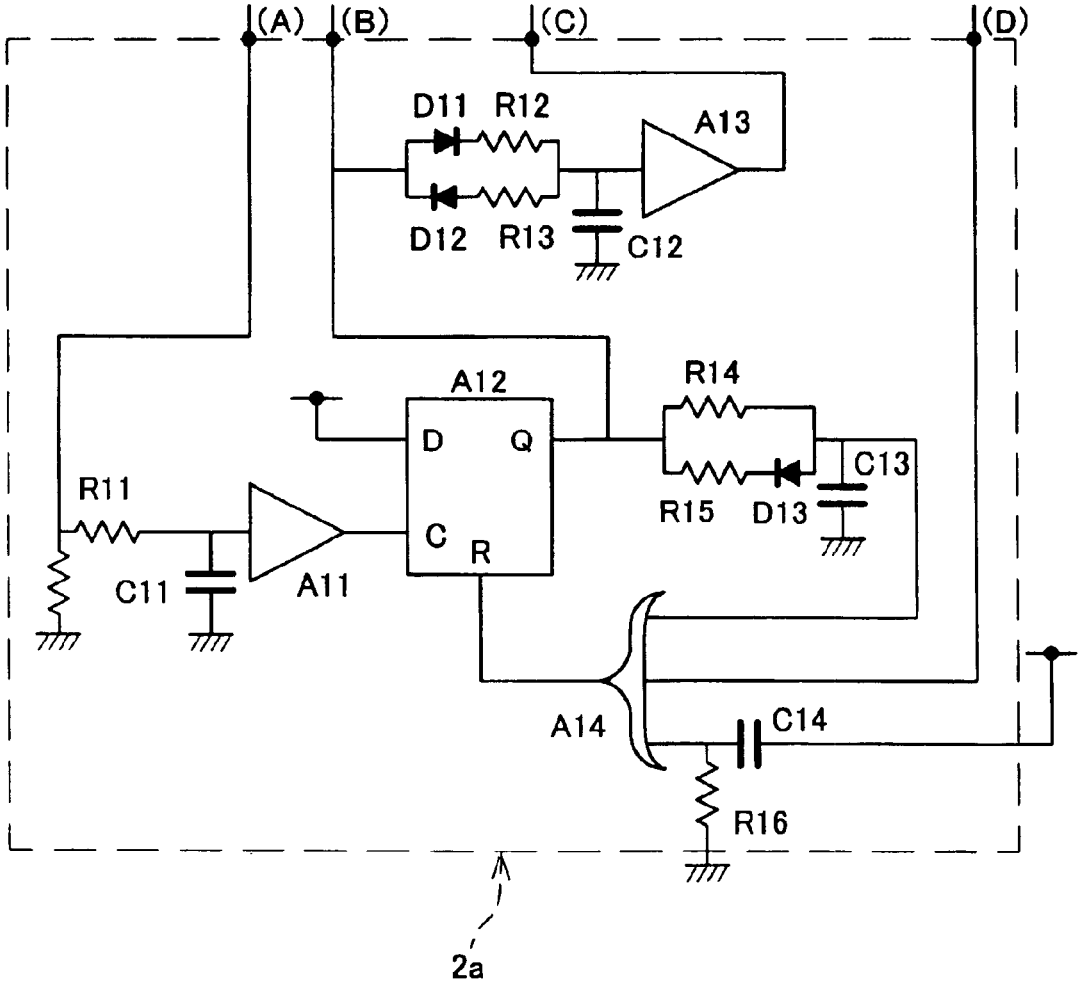
FIG. 7 is a schematic diagram showing a representative circuit of controller 2*a* of FIG. 5.

Next, a representative circuit diagram for controller 2*a* will be explained with reference to FIG. 7. As shown in FIG. 7, resistor R11 and condenser C11 prevent noise and chattering from trigger switch SW2 via terminal (A). Furthermore, A11 and A13 are elements for transforming analog voltage into a step shaped voltage (e.g., high or low level voltage). A comparator or, for simplicity, a CMOS-IC gate circuit may be utilized in A11 and A13. A12 may be a flip-flop circuit. When power source switch SW1 is turned on, flip-flop circuit is reset by means of a signal input from condenser C14 via OR circuit A14, and flip-flop circuit A12 outputs an OFF signal (i.e., low level signal) from output terminal Q.

When trigger switch SW2 is turned on, a clock signal is input to input terminal C of flip-flop circuit A12, whereupon the output terminal Q assumes a high level. As a result, terminal (B) of controller 2*a* assumes a high level and switch Q1 of FIG. 5 is turned on, whereby the excitatory current flows through the coil L1 of plunger release 6. Together with this, charging begins of a condenser C12 via a diode D11 and a resistor R12. At this juncture, after a time constant (i.e., the time τ1 in FIG. 6B) has elapsed, the output of the element A13 assumes a high level. As a result, switches Q3, Q4, Q2 of FIG. 5 are turned on and the current begins to flow through solenoid coil L2.

When the current flowing through solenoid coil L2 exceeds the determined value i1, the input from terminal (D) assumes a high level, the flip-flop circuit A12 is reset by means of OR circuit A14, and the output terminal Q (i.e., the terminal (B)) assumes a low level. As a result, the current flowing to plunger release 6 is cut off, and plunger 5 is released from plunger release 6. On the other hand, when the charge of condenser C12 is discharged by means of resistor R13 and a diode D12, after a time constant (i.e., the time τ2 in FIG. 6B) has elapsed, the output (i.e., terminal (C)) of the element A13 assumes a low level. By this means, the supply of current to solenoid coil L2 is cut off.

In addition, resistor R14 and condenser C13 that have a time constant longer than the time constant τ2 are preferably provided for the case when flip-flop circuit A12 is not reset by the process described above. That is, the voltage of condenser C13 falls below a predetermined voltage after a predetermined time has passed even if the current through solenoid coil L2 did not exceed the determined value i1, and flip-flop circuit A12 is reset by means of OR circuit A14. The purpose of this is to deal with an increase in the direct current resistance R of solenoid coil L2 caused by the heating of solenoid coil L2, or a further decrease in the voltage of switch Q2 (see FIG. 5). On the other hand, when flip-flop circuit A12 is reset by the process described above, the charge of condenser C13 is rapidly discharged via diode D13 and resistor R15, thus preventing it from interrupting the operation of other circuits.

As is clear from the above, the stapler of the above illustrated representative embodiment stores the electrical energy supplied from the power source as magnetic energy in the solenoid coil, and utilizes this stored magnetic energy for striking the staples. The magnetic energy stored in the solenoid coil has no relationship with the power source voltage, and is instead determined by the inductance and coil current of the solenoid coil. Consequently, large staples can be struck even if the power source voltage is low.

Moreover, the above illustrated representative embodiment is merely an example wherein the technique of the present teachings was applied to a stapler, and the technique of the present teachings can be applied to other power tools (e.g., nailers, tackers).

Further, the technique of the present teachings can be applied to power tools having a terminal for coupling to an external power source (e.g., alternating current, commercial power source). That is, the external power source may be connected to a solenoid coil via the terminal of the power tool and the external power source supplies a current to the solenoid coil. Further, if the external power source supplies alternating current, the power tool may also include a rectifying circuit, which may comprise a diode bridge. The alternating current from the external power source may be rectified by the rectifying circuit, thereby being transformed into a direct current. In the alternative, the external power source may be connected to the terminal via an adapter, which may include a rectifying circuit. The alternating current from the external power source may be rectified by the rectifying circuit of the adapter, whereby a direct current is supplied to the terminal of the power tool.

Finally, although the preferred representative embodiment has been described in detail, the present embodiment is for illustrative purpose only and not restrictive. It is to be understood that various changes and modifications may be made without departing from the spirit or scope of the appended claims. In addition, the additional features and aspects disclosed herein also may be utilized singularly or in combination with the above aspects and features.

What is claimed is:

1. A power tool comprising:

a battery, a solenoid coil storing the electrical energy supplied from the battery as magnetic energy, a switch electrically connecting and disconnecting the battery with the solenoid coil, a plunger for striking a faster, the plunger being attracted by electromagnetic force stored in the solenoid coil and moving from a first position to a second position, wherein the plunger strikes the fastener when the plunger reaches the second position, means for retaining the plunger in the first position, and a controller coupled to the switch and the retaining means, the controller (1) turning on the switch when the plunger is retained by the retaining means in the first position, and (2) turning off the retaining means in order to stop retaining the plunger when the current flowing through the solenoid coil reaches a predetermined value.

2. A power tool as in claim 1, wherein the controller maintains the switch in an ON state during a first predetermined period even after having turned off the retaining means.

3. A power tool as in claim 1, wherein the controller simultaneously turns the switch OFF and turning off the retaining means to stop retaining the plunger.

4. A power tool as in claim 1, wherein the controller, after having turned on the switch, turns off the switch after a second predetermined period has elapsed even in the case where the current value did not reach the predetermined value.

5. A power tool as in claim 4, wherein the predetermined value varies in accordance with the battery voltage.

6. The power tool of claim 1 wherein the fastener comprises a nail.

7. The power tool of claim 1 wherein the fastener comprises a staple.

8. A power tool comprising:

a plunger for striking a fastener, a solenoid coil for driving the plunger from a first position to a second position, wherein the plunger strikes fastener when the plunger reaches the second position, a switch turning ON and OFF a current from a power source to the solenoid coil, means for retaining the plunger in the first position, and a controller coupled to the switch and the retaining means, the controller (1) turning on the switch in order to supply current from the power source to the solenoid coil when the plunger is retained by the retaining means in the first position, and (2) turning off the retaining means in order to stop retaining the plunger when the current flowing through the solenoid coil reaches a predetermined value, whereby the plunger is being attracted by the electromagnetic energy stored in the solenoid coil, and moves from the first position to the second position.

9. A power tool as in claim 8, wherein the controller maintains the switch in an ON state during a first predetermined period even after having turned off the retaining means.

10. A power tool as in claim 8, wherein the controller simultaneously turns the switch OFF and turning off the retaining means to stop retaining the plunger.

11. A power tool as in claim 8, wherein the power source comprises an external power source.

12. A power tool as in claim 8, wherein the power source comprises rechargeable battery cells.

13. A power tool as in claim 12, wherein the controller, after having turned on the switch, turns off the switch after a second predetermined period has elapsed even in the case where the current value did not reach the predetermined value.

14. A power tool as in claim 13, wherein the predetermined value varies in accordance with the battery voltage.

15. The power tool of claim 8 wherein the fastener comprises a nail.

16. The power tool of claim 8 wherein the fastener comprises a staple.

17. A power tool comprising:

a battery, a solenoid coil storing the electrical energy supplied from the battery as magnetic energy, a switch electrically connecting and disconnecting the battery with the solenoid coil, a plunger being attracted by electromagnetic force stored in the solenoid coil and moving from a first position to a second position, means for retaining the plunger in the first position, and a controller coupled to the switch and the retaining means, the controller (1) turning on the switch when the plunger is retained by the retaining means in the first position, and (2) turning off the retaining means in order to stop retaining the plunger when the current flowing through the solenoid coil reaches a predetermined value, wherein the controller simultaneously turns the switch OFF and turning off the retaining means to stop retaining the plunger.

18. A power tool comprising:

a battery, a solenoid coil storing the electrical energy supplied from the battery as magnetic energy, a switch electrically connecting and disconnecting the battery with the solenoid coil, a plunger being attracted by electromagnetic force stored in the solenoid coil and moving from a first position to a second position, means for retaining the plunger in the first position, and a controller coupled to the switch and the retaining means, the controller (1) turning on the switch when the plunger is retained by the retaining means in the first position, and (2) turning off the retaining means in order to stop retaining the plunger when the current flowing through the solenoid coil reaches a predetermined value, wherein the controller, after having turned on the switch, turns off the switch after a second predetermined period has elapsed even in the case where the current value did not reach the predetermined value.

19. A power tool as in claim 18, wherein the predetermined value varies in accordance with the battery voltage.

20. A power tool comprising:

a plunger, a solenoid coil for driving the plunger from a first position to a second position, a switch turning ON and OFF a current from a power source to the solenoid coil, means for retaining the plunger in the first position, and a controller coupled to the switch and the retaining means, the controller (1) turning on the switch in order to supply current from the power source to the solenoid coil when the plunger is retained by the retaining means in the first position, and (2) turning off the retaining means in order to stop retaining the plunger when the current flowing through the solenoid coil reaches a predetermined value, whereby the plunger is being attracted by the electromagnetic energy stored in the solenoid coil, and moves from the first position to the second position, wherein the controller simultaneously turns the switch OFF and turning off the retaining means to stop retaining the plunger.

21. A power tool comprising:

a plunger, a solenoid coil for driving the plunger from a first position to a second position, a switch turning ON and OFF a current from a power source to the solenoid coil, said power source comprising rechargeable battery cells, means for retaining the plunger in the first position, and a controller coupled to the switch and the retaining means, the controller (1) turning on the switch in order to supply current from the power source to the solenoid coil when the plunger is retained by the retaining means in the first position, and (2) turning off the retaining means in order to stop retaining the plunger when the current flowing through the solenoid coil reaches a predetermined value, whereby the plunger is being attracted by the electromagnetic energy stored in the solenoid coil, and moves from the first position to the second position, wherein the controller, after having turned on the switch, turns off the switch after a second predetermined period has elapsed even the case where the current value did not reach the predetermined value.

22. A power tool as in claim 21, wherein the predetermined value varies in accordance with the battery voltage.

* * * * *